United States Patent [19]

Wilkinson et al.

[11] Patent Number: 4,839,475

[45] Date of Patent: Jun. 13, 1989

[54] MODULAR SWITCH ASSEMBLY HAVING WIPING CONTACTS

[75] Inventors: Ivan E. Wilkinson, Lynchburg; Robert W. Auxier, Forest, both of Va.

[73] Assignee: Limitorque Corporation, Lynchburg, Va.

[21] Appl. No.: 188,357

[22] Filed: Apr. 29, 1988

[51] Int. Cl.[4] ..... H01H 1/18

[52] U.S. Cl. ..... 200/5 R; 200/16 A; 200/241; 200/243; 200/574

[58] Field of Search ..... 200/16 A, 241, 153 LB, 200/307, 340, 243, 5 R

[56] References Cited

U.S. PATENT DOCUMENTS

| | | | |
|---|---|---|---|
| 4,389,552 | 6/1983 | Sorenson | 200/68 |
| 4,504,713 | 3/1985 | Hennessey | 200/241 |
| 4,514,609 | 4/1985 | Fricke et al. | 200/159 A |
| 4,650,935 | 3/1987 | Ootsuka | 200/16 A |
| 4,689,451 | 8/1987 | Resh | 200/6 C |
| 4,691,086 | 9/1987 | Habecker et al. | 200/159 R |
| 4,694,130 | 9/1987 | Kitzmann et al. | 200/314 |
| 4,700,162 | 10/1987 | Hirawata et al. | 200/241 |

*Primary Examiner*—A. D. Pellinen
*Assistant Examiner*—Morris Gimsburg
*Attorney, Agent, or Firm*—Paul & Paul

[57] ABSTRACT

A switch assembly for a geared limit switch for valve actuators is formed from aligned switch modules. The switch modules includes a pair of switch units, each switch unit having a plunger and a movable contact plate mounted between two springs. As the plunger is driven inward, a camming element on the plunger contacts an edge of an aperture in the movable contact plate, forcing the plate to move in a direction perpendicular to the line of plunger travel. The inward motion of the plunger and the camming action continue after the contacts have closed, wiping the contacts mounted on the movable plate across the surfaces of the stationary contacts. When the plunger is released, an outer edge of the movable plate engages a beveled inner wall of the switch unit housing, returning the movable contact plate to its original position.

8 Claims, 3 Drawing Sheets

MODULAR SWITCH ASSEMBLY HAVING WIPING CONTACTS

BACKGROUND OF THE INVENTION

1. Field of the Invention

This invention relates generally to electrical switches, and more specifically to modular electrical switch assemblies in which a number of switch units are simultaneously actuated by cam members fixed to a common shaft.

2. Brief Description of Prior Art

Electromechanical valve actuators are used to open and close valves controlling fluid flow in a great variety of process environments. For example, electromechanical valve actuators are frequently found in power generating stations, oil refineries, and chemical manufacturing plants. The ability to quickly and accurately open and close fluid control valves from a central location is essential to efficient operation and safety.

Electromechanical valve actuator frequently include gear driven limit switch assemblies for valve actuator control and state sensing purposes. Typically, a geared limit switch assembly includes a mechanical counter, gear-driven directly from the actuator power train, which is used to count actuator drive sleeve turns. Drive sleeve turns (clockwise or counterclockwise) are used to predict valve stem location (e.g., open, closed, midtravel). The counter section of the geared limit switch often includes a clutch so that it can be disengaged and the counter travel may be set to correspond with distinct valve stem locations. Typically, a geared limit stitch has one or more output shafts fitted with a number of cams The cams in turn are employed to make or break electrical contacts as the output shaft rotates through predetermined positions or set points corresponding to the selected valve stem locations. The contacts are connected as elements in electric circuits which control the operation and sense the state of the valve actuator.

A key requirement for electrical contacts is that they retain excellent electrical conductivity during service event after many many make/break cycles. Contact fouling by the deposit of dirt or formation of an oxide coating on the surface of the contacts reduces their electrical conductivity. When electric contacts are opened or closed arcing between the contacts may occur. Deleterious arcing can be aggravated be fouled contacts, and can lead to pitting of the contact surface. Contact fouling is often aggravated by industrial environments. However, contact fouling can be reduced by moving the surface of one contact of a pair across the surface of the other contact after the contacts have been closed ("wiping"). Electrical switches having contact wiping action are disclosed, for example, in U.S. Pat. Nos. 4,504,713, 4,514,609 and 4,650,935.

SUMMARY OF THE INVENTION

The present invention provides an improved switch module having self wiping electrical contacts for use in valve actuator geared limit switches. The switch module has increased operational reliability as the wiping action tends to clean any oxidized layer or dirt from the contact faces which would otherwise increase contact resistance, aggravating arcing and tending to cause pitting of the contacts.

The switch module comprises a pair of switch units assembled in a common housing. The switch modules themselves can be assembled into a switch assembly including a plurality of units to provide as many sets of contacts as desired for a particular valve actuator application.

Each switch unit in the switch module comprises a housing section including a central cavity and an upper cavity as well as a movable contact plate member having a plurality of contacts. The contact plate member is mounted for movement in the central cavity of the housing section between a fully open position and a closed position. The switch unit further comprises a plurality of stationary contact members. Each of the stationary contact members is provided with a stationary contact disposed opposite of corresponding predetermined contact of the movable contact plate. The stationary contacts abut the corresponding predetermined contacts of the movable contact plate when the contact plate is in the closed position.

In addition, the switch unit comprises a plunger member mounted in the housing for reciprocating motion in a line between a first position in which the plunger protrudes from the housing and the contacts are open, and a second position in which the contacts are closed and the protrusion of the plunger from the housing is minimized. The unit has a first resilient biasing means or spring extending between the movable contact plate and the reciprocating plunger member for biasing the movable contact plate member toward the stationary contacts. Further, the switch unit includes a second resilient biasing means or spring positioned in the upper cavity of the housing section. The second spring has a first and a second predetermined range of lengthwise extension. While in the first predetermined range of extension, the second spring extends between the housing and the movable contact plate member for biasing the movable contact plate member away from the stationary contacts. However, while in the second predetermined range of extension, the second spring extends between the housing and the plunger member and biases the plunger away from the movable contact plate.

The movable contact plate member is mounted between the first and second biasing means such that as the plunger member moves under an externally applied force between the first position and the second position, the movable contact plate member is displaced in a first predetermined direction from the fully opened position toward and into contact with the stationary contacts. Initially, the applied force is transmitted through the plunger and the first spring to the movable contact plate. Initially, also, the second spring extends between the movable contact plate and the stationary housing, so that the second spring is compressed by and opposes the force applied to the movable contact plate. However, after the contacts have closed, as the plunger continues its inward travel toward the second position, a portion of the plunger engages the second spring such that the movable contact plate is released from engagement with the second spring and the second spring extends between the housing and the plunger. Thus, the contacts are securely held together in the closed position by the external force acting through the plunger body and the compressed first spring. As the plunger member moves between the second position and the first position, the movable contact plate member moves from the fully closed position in a second predetermined direction generally opposite the first predetermined direction away from and out of contact with the stationary contacts.

In the improved switch units of the present invention, the reciprocating plunger member includes a camming means having a camming surface. In addition, the movable contact plate member has an outer camming edge, and a camming aperture having an inner camming edge. The plunger member camming surface is adapted to engage the inner camming edge of the aperture of the movable contact plate member as the plunger member is displaced in the first predetermined direction and to displace the movable contact plate member in a first transverse direction generally perpendicular to the line of plunger member motion from an initial closed position to the fully closed position, thus providing contact wiping action.

In addition, the central cavity of the improved switch unit includes a camming surface for engaging the outer camming edge of the movable contact plate member as the movable contact plate member is displaced in the second predetermined direction. The camming surface of the central cavity is adapted to displace the contact plate member in a second transverse direction generally perpendicular to the line of plunger member motion and generally opposite the first transverse direction to return the movable contact plate member to the fully opened position when the plunger member is again in the first position.

DETAILED DESCRIPTION OF THE PREFERRED EMBODIMENTS

Figure 1:
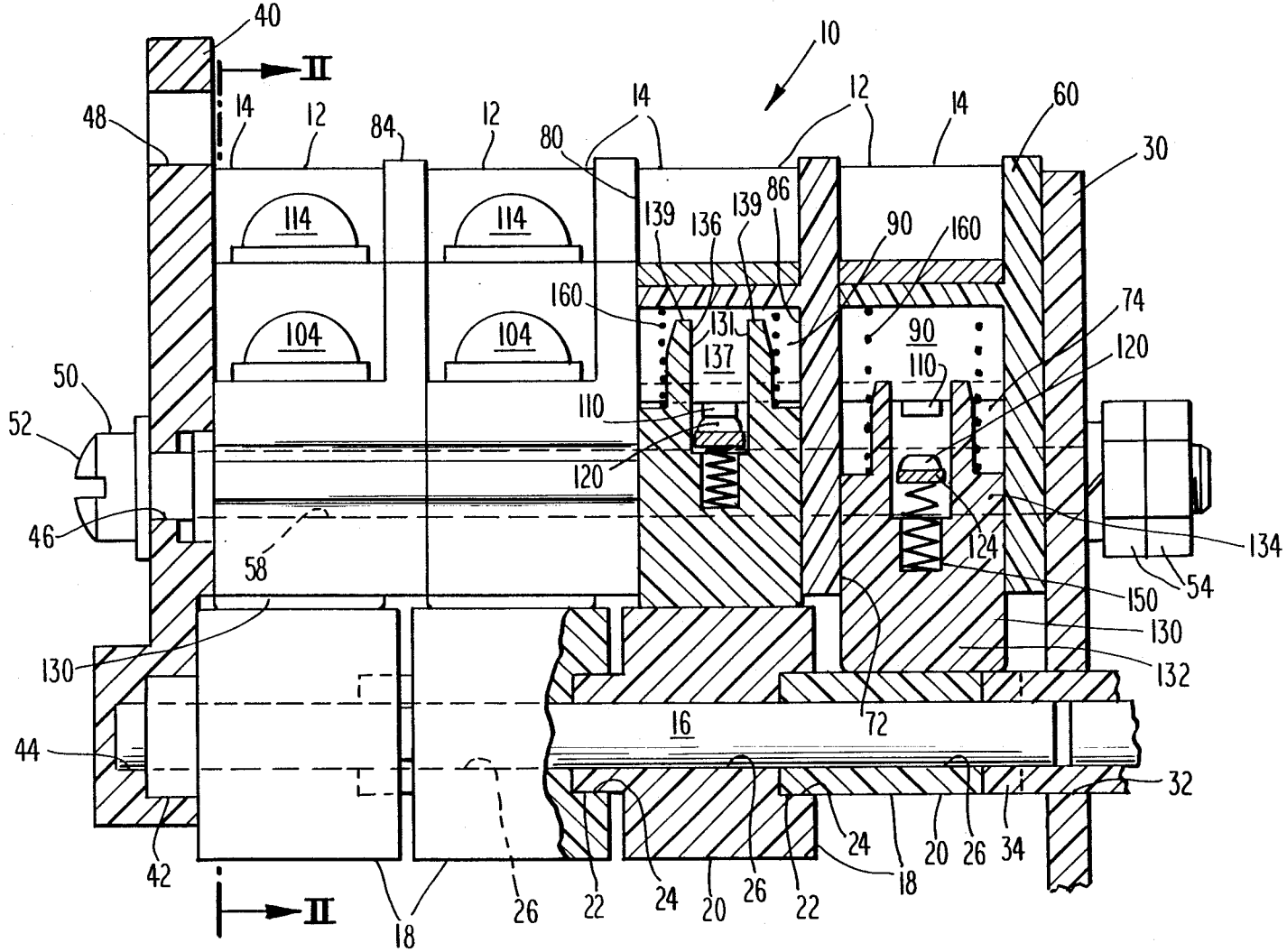
FIG. 1 is an elevational view, partially in section, of a presently preferred embodiment of a switch assembly according to the present invention.

Referring now to the drawings in detail, wherein like reference numerals indicate like elements in each of the several views, reference is first made to FIG. 1, wherein a switch assembly 10 according to the present invention is illustrated in a partially sectional, side elevational view.

The switch assembly 10 includes a plurality of aligned switch modules 12 secured between a switch assembly mounting plate 30 and an end plate 40 by a pair of conventional fastening means 50, including a pair of bolts 52 extending through aligned apertures 58 formed in the switch modules 12, and secured with a lock washer and a pair of nuts 54. Only one of the two fastening means 50 is visable in FIG. 1.

The switch assembly 10 forms a portion or subassembly of a geared limit switch assembly (not shown) which is secured to the drive sleeve of a valve actuator (not shown). The rotational motion of the valve actuator drive sleeve is transmitted through a clutch to a plurality of counter gears. The counter gears are secured to one of two pairs of output shafts 16, only one of which is visible in FIG. 1. Each output shaft 16 is mounted for rotation in a bearing 34 which is in turn fitted in an aperture 32 formed in the mounting plate 30.

Mounted for rotation with the output shaft 16 are a plurality of cam members 18, each cam member 18 being associated with a corresponding switch unit 14. As best seen in the fragmentary sectional view of FIG. 2, each cam member 18 has an elongated cam body 20 and an integrally formed cruciform protrusion 22 extending from one end of the cam body 20. At the opposite axial end of the cam body 20 is formed a generally cruciform recess 24 (FIG. 1) for receiving the cruciform protrusion 22 of an adjacent cam member 18. Each cam member 18 includes an axial, generally cylindrical, aperture 26 for mounting the cam member 18 on the shaft 16 for rotation with the shaft 16.

The cruciform protrusion 22 and mating recesses 24 require that adjacent cam members 18 be mounted on the shaft 16 so that their elongated cam bodies 20 are either parallel or perpendicular to each other. Depending on their angular orientation, adjacent cam bodies which are parallel to each other correspond to either normally open (n.o.) or normally closed (n.c.) contacts, while cam bodies 18 which are perpendicular correspond to normally open and normally closed contacts.

As shown in FIG. 1, the end plate 40 includes a first generally cylindrical recess 42 for receiving and rotatively mounting the cruciform protrusion 22 of the terminal or outboard cam member 18 mounted on the shaft 16. The end plate 40 further includes a second generally cylindrical recess 44 for receiving and rotatively positioning the outboard end of the shaft 16. The end plate 40 also includes a pair of apertures 46 for the fastening members 50, as well as a pair of additional apertures 48 for mounting the geared limit switch assembly.

Figure 2:
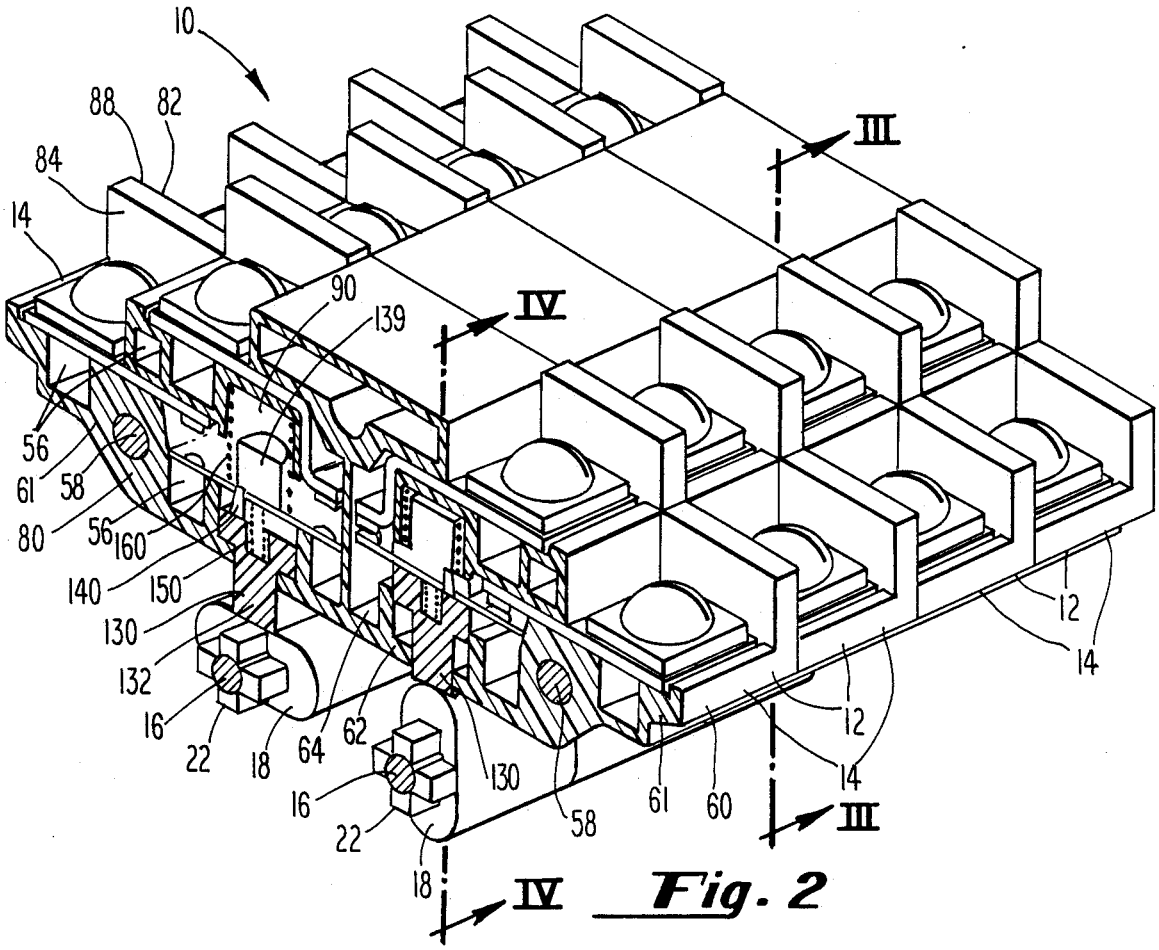
FIG. 2 is a fragmentary, sectional perspective view of the switch assembly of FIG. 1 taken along the line II—II.

As best seen in FIG. 2 the switch assembly 10 is formed from a plurality of aligned switched modules 12 which are secured together by the fastening members 50 (FIG. 1) extending through pairs of aligned apertures 58 formed in each of the switch modules 12. As shown in FIG. 2 each switch module 12 includes a bilaterally symmetrical pair of switch units 14. The structure and operation of a single switch unit 14 of a module 12 will be discussed as the structure of the other switch unit 14 in the will be identical.

Both the switch units 14 in module 12 share a common housing 60, preferably molded from an electrically insulating thermoplastic or thermosetting material. The housing 60 includes a pair of bilaterally symmetric housing sections 61. A plurality of cavities 56 are formed in each housing section 61 for a variety of purposes. In general, the cavities 56 are accessible from a first side 80 of the housing 60, the cavities 56 being closed on the second side 82 of the housing 60 by a housing rear wall 84 having an inner surface or face 86 (best seen in FIG. 3 and 4) and an outer surface or face 88 (FIG. 1 and 2).

Figure 3:
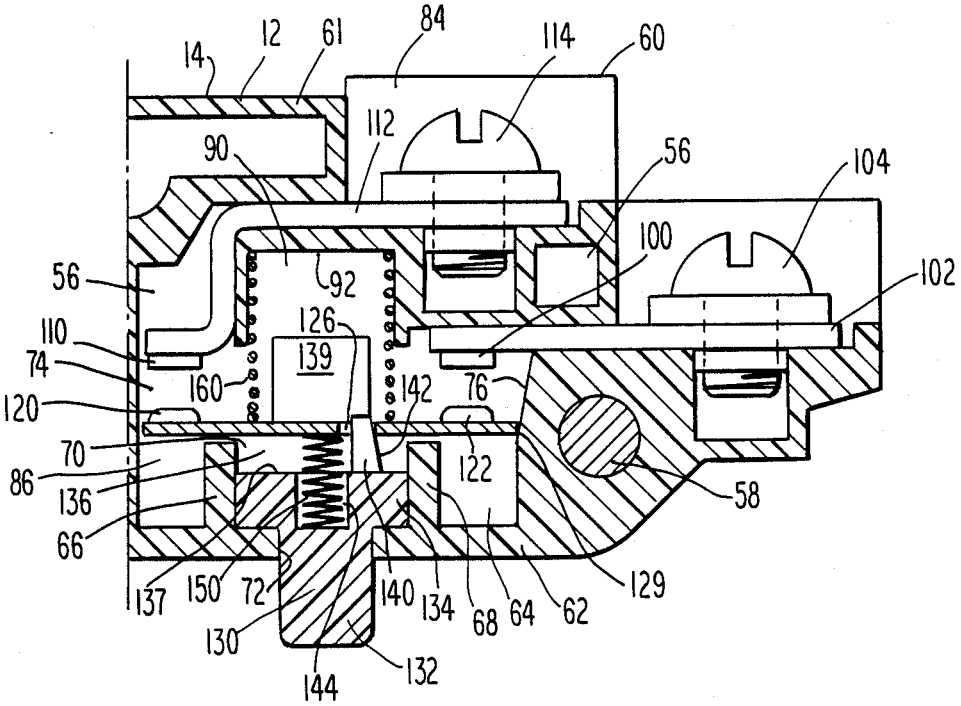
FIG. 3 is a fragmentary sectional elevational view of the switch assembly of FIG. 2 taken along the line III—III and depicting a switch unit having contacts in the fully opened position.
Figure 4:
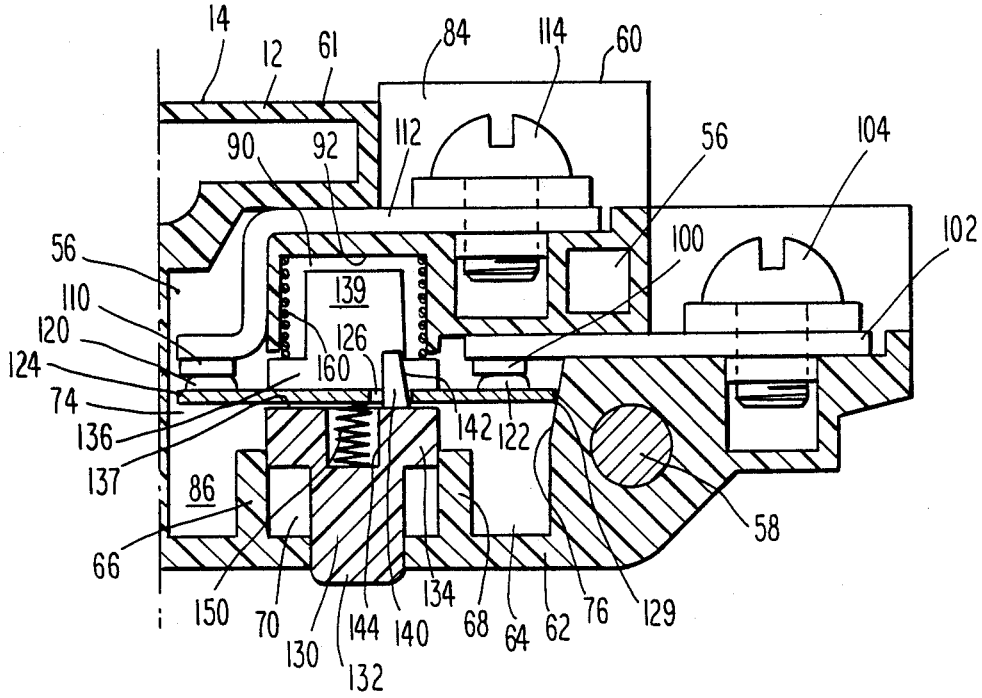
FIG. 4 is a fragmentary elevational sectional view of the switch assembly of FIG. 2 taken along the line IV—IV and depicting a switch unit having contacts in the fully closed position.

As best seen in FIGS. 3 and 4, each switch unit 14 includes a first stationary contact 100 bonded by conventional means to an electrically conductive first contact plate 102 to which is secured a first terminal 104. The first stationary contact 100 extends into a central cavity 74 formed in the housing section 61. The second stationary contact 110 is bonded to a second contact plate 112 to which is secured a second terminal 114. The second stationary contact 110 also extends into the central cavity 74 if the housing section 61 and is generally coplanar with the first stationary contact 100. The first and second contact plates 102, 112 are secured within the housing section 61 in a conventional manner, the contact plates 102, 112 being press fit into housing cavities sized to securely receive them.

Figure 5:
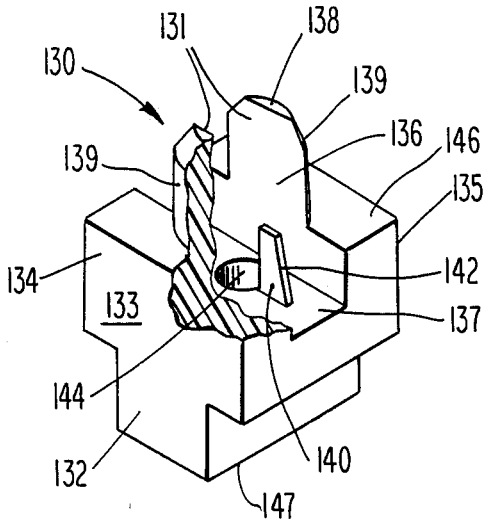
FIG. 5 is a cutaway, partially sectional perspective view of a plunger member for use in the switch assembly shown in FIG. 1.
Figure 6:
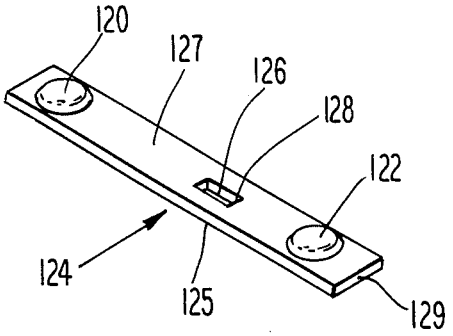
FIG. 6 is a perspective view of a movable contact plate number for use in the switch assembly shown is FIG. 1.

Each switch unit 14 also includes a movable contact plate 124, best seen in the perspective view of FIG. 6, having a lower surface 125 and an upper surface 127 to which are bonded first and second contacts 120, 122 which are displacable or movable with the movable contact plate 124. The switch unit 14 also includes a movable plunger or plunger member 130, best seen in the perspective view of FIG. 5, and preferably formed from an electrically insulating material. As best seen in FIGS. 3 and 4, the movable contact plate 124 and the plunger 130 are mounted between a first and a second biasing means or springs 150, 160.

The plunger 130, movable contact plate 124, stationary contact plates 102, 112 and springs 150, 160 are shown in FIG. 2, displaced outward from the housing 60 and in section.

As best seen in FIG. 5, the plunger 130 includes generally boxlike body 134 having a generally rectangular upper surface 146 and lower surface 147. Extending from the generally rectangular lower end of the plunger body 134 is a generally boxlike and integrally formed lower section 132. The plunger body 134 and lower section 132 share a pair of parallel generally T-shaped surfaces 133, 135. Extending from the upper end of the plunger body 134 is a generally cylindrical upper section 138. The upper section 138 is divided into two symmetric segments 139 by a slot 136 sized to receive the movable contact plate 124. The slot 136 extends into the plunger body 134 and is bounded at the bottom by a generally rectangular lower surface 137 formed therein. A generally cylindrical recess 144 is formed in the plunger body 134, extending from the bottom surface 137 of the slot 136, for receiving and positioning the first spring 150 (FIG. 3). Extending upward from the bottom surface 137 of the slot 136 and adjacent the first spring recess 144 is a plunger cam element or cam 140 for a purpose to be described.

As best seen in FIGS. 3 and 4 the housing section 61 includes a lower cavity 64 bounded at the bottom by lower wall 62 from which upwardly extend a pair of generally parallel side walls 66, 68 positioned to form two sides of a plunger well 70. The back side of the plungers well 70 is formed by an inner surface 86 of the rear wall 84 of the housing 60. The front side of the plunger well 70 is covered by the outer or rear surface 88 of the back wall 84 of the housing 60 of an adjacent module 12 or by the end plate 40 (FIG. 1) when the module 12 is assembled into a switch assembly 10. The plunger well 70 is sized to slidably mount the plunger body 134 and to confine the plunger 130 to movement in a line generally perpendicular to the plane defined by the stationary contacts 100, 110.

The bottom wall 62 has a generally rectangular aperture 72 formed therein to permit passage of the bottom section 132 of the plunger 130 therethrough. The housing section 61 also includes an upper cavity 90 sized to receive the second spring 160.

As best seen in FIG. 3, the first spring 150 extends between the bottom surface of the recess 144 formed in the lower surface 137 of the slot 136 in the plunger 130 and the lower surface 125 of the movable contact plate 124. The second spring 160 extends between an upper or inner surface 92 of the upper cavity 90 and the upper surface 127 of the movable contact plate 124 or the upper surface 146 of the plunger body 134 depending on the extent to which the plunger 130 is pushed by the external force exerted by a cam member 18 into the housing section 61. Both the first and the second springs 150, 160 are generally helical. The two segments 139 of the upper section 138 of the plunger 130 extend within the second spring 160. In addition to the bottom surface 137, the slot 136 has a pair of generally parallel inner surfaces 131 which are generally perpendicular to the bottom surface 137 (best seen in FIG. 5), and the movement of the movable contact plate 124 is constrained by the inner surfaces 131 of the slot 136 (best seen in FIG. 1).

The first and second springs 150, 160 (FIGS. 3 and 4) are selected such that when no external force is being exerted upon the plunger 130, the force of the second spring 160 displaces the movable contact plate 124 downward so that the first and second contacts 120, 122 of the movable contact plate 124 are separated by air gaps from the opposed corresponding first and second stationary contacts 100, 110. Further, the force of the second spring 160 is transmitted through the movable contact plate 124 to the first spring 150 and thereby to the plunger 130 to drive the plunger 130 to the limit of its outward travel as defined by contact of the bottom surface of the body 134 of the plunger 130 with the bottom wall 62 of the housing section 61. This is the resting or equilibrium position of the plunger 130 in the housing section 61.

When an external force is applied to the bottom section 132 of the plunger 130, the plunger 130, confined within the generally parallel walls 66, 68 defining the plunger well 70, travels in a generally straight line upward. The external force applied to the plunger 130 is transmitted through the first spring 150 to the movable contact plate 124, and through the movable contact plate 124 to the second spring 160. As the plunger 130 travels upward the movable contact plate 124 is also forced upward: ultimately the contacts 120, 122 of the movable contact plate 124 come into contact with the corresponding first and second stationary contacts 100, 110.

As the plunger 130 moves upward initially, through a first predetermined range of displacement upward from its equilibrium position, the movable contact plate 124 is carried upward between the two springs 150, 160. However, at a predetermined plunger displacement the upper surface 146 of the plunger body 134 engages the lower end of the second spring 160, and the lower end of the second spring 160 is simultaneously disengaged from the upper surface 127 of the movable contact plate 124. Thereafter, as the plunger 130 moves upward through a second predetermined range of displacement, the contacts 120, 122 of the movable contact plate 124 are biased against the stationary contacts 100, 110 by the force exerted by the first spring 150 on the lower surface 125 of the movable contact plate 124, and the plunger 130 compresses the second spring 160 in the upper cavity 90. In geared limit switch assemblies the external force is applied to the plunger 130 by the elongated cam member 18 rotating on the shaft 16.

In the present invention means are provided for wiping the surface of the contact 120, 122 of the movable contact plate 124 across the faces of the corresponding first and second stationary contacts 100, 110. As noted above, the plunger 130 includes a camming element or cam 140 having a camming surface 142 (FIG. 5). The plunger camming element 140 is adapted to protrude through a generally rectangular aperture 126 formed in the movable contact plate 124 (FIG. 6). The plunger camming element 140 has a generally rectangular camming surface or bevel 142 formed on one side thereof. As best seen in FIG. 3, when the plunger camming surface 142 is positioned to engage an inner or first camming edge 128 in the aperture 126 formed in the movable contact plate 124. As the plunger is displaced in a first predetermined direction (upward in FIG. 3), the plunger camming element 140 begins to travel through the contact plate aperture 126. As it does so, the movable contact plate 124 is displaced in a first transverse direction generally perpendicular to the line of motion of the plunger 130 (rightward in FIG. 3). The travel of the plunger camming element 140 through the contact plate aperture 126 continues after the first and second movable contacts 120, 122 have come into contact with the first and second stationary contacts 100, 110 so that the movable contact plate 124 and the contacts 120, 122 attached thereto continue to move in the first transverse direction, the surfaces of the contacts 120, 122 of the movable contact plate 124 thereby being wiped across the surfaces of the first and second stationary contacts 100, 110 from an initial closed position to a second or fully closed position (FIG. 4).

When the contacts are opened the movable contact plate 124 is returned to its initial position as follows. When the external force which has been applied to the lower section 132 of the plunger 130 is released, the force of the compressed first and second springs 150, 160 forces the plunger 130 downward in the plunger well 70 in a line. Initially, the second spring 160, which extends from the inner surface 92 of the upper cavity 90 to the upper surface 146 of the plunger body 134, pushes directly against the plunger 130 when the external force is released. The contacts 120, 122 of the movable contact plate 124 continue to remain in contact with the stationary contacts 100, 110 as the plunger 130 begins its downward travel, because the first spring 150 continues to apply force against the lower surface 125 of the movable contact plate 124.

However, eventually as the plunger 130 travels downward and outward in the plunger well 70, the top surface 146 of the plunger body 134 drops below the upper surface 127 of the movable contact plate 124, which up to this point had remained in the fully closed position, and the second spring 160 contacts the upper surface 127 of the movable contact plate 124.

The force exerted by the second spring 160 on the upper surface 127 of the movable contact plate 124 is generally downward following the motion of plunger 130. However, the movable contact plate 124 does not track the downward motion of the plunger 130 exactly. The central cavity 74 is bounded on one side by a outboard wall 76 which is beveled or canted at a slight angle from the line defined by the travel of the plunger 130 in the plunger well 70. Further, the outboard wall 76 of the central cavity 74 is positioned so that it is contacted by an outer edge 129 of the movable contact plate 124. As the movable contact plate 124 travels downward in a second predetermined direction generally opposite the first predetermined direction as it being urged by the second spring 160, contact between the outer or second camming edge 129 of the movable contact plate 124 and the surface of the outboard wall 76 of the central cavity 74 forces the movable contact plate 124 to travel in a second transverse direction, generally perpendicular to the line of plunger motion and generally opposite the first transverse direction, to return the movable contact plate 124 the fully open position (FIG. 3) when the plunger 130 is again in the first position.

In the illustrated embodiment the camming surface of the outboard wall 76 engages the outer camming edge 129 of the movable contact plate 124 when the movable contact plate 124 is in the fully closed position. However, it is only necessary that the movable contact plate 124 be displaced transversely by the distance necessary to return it to its initial transverse position by the time the plunger 130 has completed its downward travel. Thus, for example, contact between the outer camming edge 128 of the movable contact plate 124 and the camming surface of the outboard wall 76 could occur after a movable contact plate 124 has begun its downward travel. Similarly, if desired the transverse displacement of the movable contact plate 124 could be completed before the movable contact plate 124 has completed its downward travel.

A similar consideration applies to the initial transverse displacement of the movable contact plate 124 by the force exerted by the plunger cam 140 on the inner edge 128 of the contact plate aperture 126: The plunger cam 140 and the contact plate aperture 126 could be sized and positioned to urge the movable contact plate 124 in the first transverse direction after the movable and stationary contacts have come together, thus providing the wiping action.

Various other modifications can be made in the details of the embodiments of the switch assembly for the present invention, all within the spirit and scope of the invention as defined by the appended claims. For example, the movable contact plate could have more than two contacts, with corresponding stationary contacts also being provided.

We claim:

1. In switch unit comprising:

a housing including a central cavity and an upper cavity;

a movable contact plate member having a plurality of contacts, the movable contact plate member being mounted for movement in the central cavity of the housing between a fully open position and a closed position;

a plurality of stationary contact members, each of the stationary contact members being provided with a stationary contact disposed opposite a corresponding predetermined contact of the movable contact plate member, stationary contacts abutting the corresponding predetermined movable contacts when the contact plate member is in the closed position;

a plunger member mounted in the housing for reciprocating motion in a line between a first position and a second position;

first resilient biasing means extending between the movable contact plate member and the reciprocating plunger member for biasing the contact plate member toward the stationary contacts;

second resilient biasing means positioned in the upper cavity of the housing having a first and a second predetermined range of lengthwise extension, extending between the housing and the movable contact plate member for biasing the movable contact plate member away from the stationary contacts in the first predetermined range, and extending between the housing and the plunger member for biasing the plunger member away from the movable contact plate member in the second predetermined range;

the movable contact plate member being mounted between the first and second biasing means such that as the plunger member moves between the first position and the second position the movable contact plate member is displaced from the fully open position in a first predetermined direction toward and into contact with the stationary contacts and as the plunger member moves between the second position and the first position the movable contact plate member moves from the fully closed position in a second predetermined direction generally opposite the first predetermined direction away from and out of contact with the stationary contacts;

the improvement comprising:

the movable contact plate member having an inner camming edge; and a camming aperture having an inner camming edge;

the reciprocating plunger member including a camming means having a camming surface, the plunger member camming surface being adapted to engage the inner camming edge of the aperture of the movable contact plate member as the plunger member is displaced in the first predetermined direction and to displace the movable contact plate member in a first transverse direction generally perpendicular to the line of plunger member motion from an initial closed position to the fully closed position; and the central cavity including a camming surface for engaging the outer camming edge of the movable contact plate member as the movable contact plate member is displaced in the second predetermined direction, the camming surface being adapted to displace the contact plate member in a second transverse direction generally perpendicular to the line of plunger member motion and generally opposite the first transverse direction to return the movable contact plate member to the fully open position when the plunger member is again in the first position.

2. A switch unit according to claim 1 wherein the housing includes a lower cavity, a bottom wall having an aperture, and a pair of side walls extending generally perpendicularly from the bottom wall into the lower cavity, the plunger member having a body adapted to be received between the pair of side walls, a lower section adapted to extend through the bottom wall aperture and outside the housing, an upper section having a slot formed therein having a bottom surface and a pair of generally parallel inner surfaces generally perpendicular to the bottom surface, the bottom surface of the slot having a recess formed therein for receiving and centering the first resilient biasing means, the plunger member in the housing such that the movable contact plate member extends through the slot, movement of the movable contact plate member in a direction perpendicular to the first and second transverse directions being constrained by the inner surfaces of the slot.

3. A switch unit according to claim 2 wherein the camming means of the plunger member extends generally perpendicularly from the bottom surface of the slot.

4. A switch unit according to claim 1 wherein the plunger member camming surface is adapted to engage the inner camming edge of the movable contact plate member aperture when the contact plate member is in the fully open position.

5. A switch unit according to claim 4 wherein the plunger member camming surface is adapted to engage the inner camming edge of the movable contact plate member aperture before the contact plate member is in the fully closed position.

6. A switch unit, according to claim 1 wherein the central cavity camming surface engages the outer camming edge of the movable contact plate member when the contact plate member is in the closed position.

7. A switch module comprising a pair of switch units, each switch unit comprising:

a housing including a central cavity and an upper cavity:

a movable contact plate member having a plurality of contacts, the movable contact plate member being mounted for movement in the central cavity of the housing between a fully open position and a closed position;

a plurality of stationary contact members, each of the stationary contact members being provided with a stationary contact disposed opposite a corresponding predetermined contact of the movable contact plate member, the stationary contacts abutting the corresponding predetermined movable contacts when the contact plate member is in the closed position;

a plunger member mounted in the housing for reciprocating motion in a line between a first position and a second position;

first resilient biasing means extending between the movable contact plate member and the reciprocating plunger member for biasing the contact plate member toward the stationary contacts:, second resilient biasing means positioned in the upper cavity of the housing having a first and a second predetermined range of lengthwise extension, extending between the housing and the movable contact plate member for biasing the movable contact plate member away from the stationary contacts in the first predetermined range, and extending between the housing and the plunger member for biasing the plunger member away from the movable contact plate member in the second predetermined range;

the movable contact plate member being mounted between the first and second biasing means such that as the plunger member moves between the first position and the second position the movable contact plate member is displaced from the fully open position in a first predetermined direction toward and into contact with the stationary contacts and as the plunger member moves between the second position and the first position the movable contact plate member moves from the fully closed position in a second predetermined direction generally opposite the first predetermined direction away from and out of contact with the stationary contacts;

the improvement comprising:

the movable contact plate member having an outer camming edge, and a camming aperture having an inner camming edge;

the reciprocating plunger member including a camming means having a camming surface, the plunger member camming surface being adapted to engage the inner camming edge of the aperture of the movable contact plate member as the plunger member is displaced in the first predetermined direction and to displace the movable contact plate member in a first transverse direction generally perpendicular to the line of plunger member motion from an initial closed position to the fully closed position; and the central cavity including a camming surface for engaging the outer camming edge of the movable contact plate member as the movable contact plate member is displaced in the second predetermined direction, the camming surface being adapted to displace the contact plate member in a second transverse direction generally perpendicular to the line of plunger member motion and generally opposite the first transverse direction to return the movable contact plate member to the fully open position when the plunger member is again in the first position.

8. A switch assembly comprising a plurality of switch modules, each switch module comprising a pair of switch units each switch unit comprising:

a housing including a central cavity and an upper cavity;

a movable contact plate member having a plurality of contacts, the movable contact plate member being mounted for movement in the central cavity of the housing between a fully open position and a closed position;

a plurality of stationary contact members, each of the stationary contact members being provided with a stationary contact disposed opposite a corresponding predetermined contact of the movable contact plate member, the stationary contact abutting the corresponding predetermined movable contacts when the contact plate member is in the closed position;

a plunger member mounted in the housing for reciprocating motion in a line between a first positioned a second position;

first resilient biasing means extending between the movable contact resilient member the reciprocating plunger member for biasing the contact plate member toward the stationary contacts;

second resilient biasing means positioned in the upper cavity of the housing having a first and a second predetermined range of lengthwise extension, extending between the housing and the movable contact plate member for biasing the movable contact plate member away from the stationary contacts in the first predetermined range, and extending between housing and the plunger member for biasing the plunger away from the movable contact plate member in the second predetermined range;

the movable contact plate member be mounted between the first and second biasing means such that as the plunger member moves between the first position and the second position the movable contact plate member is displaced from the fully open position in a first predetermined direction toward and into contact with the stationary contacts and as the plunger member moves between the second position and the first position the movable contact plate member moves from the fully closed position in a second predetermined direction generally opposite the first predetermined direction away from and out of contact with the stationary contacts;

the improvement comprising:

the movable contact plate member having an outer camming edge, and a camming aperture having an inner camming edge;

the reciprocating plunger member including a camming means having a camming surface, the plunger member camming surface being adapted to engage the inner camming edge of the aperture of the movable contact plate member as the plunger member is displaced in the first predetermined direction and to displace the movable contact plate member in a first transverse direction generally perpendicular to the line of plunger member motion from an initial closed position to the fully closed position; and the central cavity including a camming surface for engaging the outer camming edge of the movable contact plate member as the movable contact plate member is displaced in the second predetermined direction the camming surface being adapted to displace the contact plate member in a second transverse direction generally perpendicular to the line of plunger member motion and generally opposite the first transverse direction to return the movable contact plate member to the fully open position when the plunger member is again in the first position;

the plunger member of either switch unit in a switch module moving in a line generally parallel the line of motion to the other switch unit, and the movable contact plate member of either switch unit in a module moving in a common plate; and the plunger members of the switch units bring arranged in a pair of parallel rows in the module, the bottom sections of the plunger members of the switch units extending in two parallel rows from bottom walls of the housings, each bottom section having an outer surface adapted to be contacted by a respective external cam member, the respective external cam members being mounted on either of a pair of generally parallel shafts.

* * * * *